United States Patent [19]

Sly

[11] 4,400,840

[45] Aug. 30, 1983

[54] BOOT SHAPER

[76] Inventor: Rex Sly, Turfpits Farm, Queen's Park, Crowland, Peterborough, Cambs, England

[21] Appl. No.: 247,665

[22] Filed: Mar. 26, 1981

[30] Foreign Application Priority Data

Apr. 9, 1980 [GB] United Kingdom ..... 8011764

[51] Int. Cl.[3] ..... A43D 5/00; A43D 3/00

[52] U.S. Cl. ..... 12/114.4; 12/128 R

[58] Field of Search ..... 12/114.4, 128 R

[56] References Cited

U.S. PATENT DOCUMENTS

| | | | |
|---|---|---|---|
| D. 258,699 | 3/1981 | McPherson | 12/114.4 |
| 673,063 | 4/1901 | Ruggles et al. | 12/114.4 |
| 2,273,489 | 2/1942 | Holmes | 12/114.4 |
| 3,483,580 | 12/1969 | Cherry et al. | 12/114.4 |

*Primary Examiner*—Patrick D. Lawson

*Attorney, Agent, or Firm*—Allison C. Collard; Thomas M. Galgano

[57] ABSTRACT

A boot shaper for treating crease or stretch marks in legged boots, comprises an inflatable sock which is inflatable through an air inlet means and is deflatable through an air pressure relief means so that the sock can be pulled from a boot after use by a handle means in use of this boot shaper, the at least partially deflated sock, is inserted into the boot to be treated, inflated to pressurize the boot to an extent sufficient to reduce or eliminate the crease or stretch marks over a period of treatment, the sock then being deflated and removed from the boot using the handle means.

12 Claims, 9 Drawing Figures

BOOT SHAPER

DESCRIPTION

1. Field of the Invention

This invention relates to a boot shaper.

2. Background to the Invention

Legged boots, in particular riding boots or ladies' fashion boots, are liable with use to become marred in appearance by marks due to stretching and creasing, and it is a general object of this invention to provide means whereby these marks can be reduced or eliminated. Boot shapers in the form of an inflatable sock are already known. However, these known boot shapers have possessed various disadvantages, especially in relation to removal from the boot after use. It is a more specific object of this invention to provide an improved inflatable boot shaper which is easier and more convenient to use than known boot shapers of the inflatable kind.

SUMMARY OF THE INVENTION

According to one aspect of the invention there is provided a boot shaper which comprises a sock of impervious flexible material, said sock having a foot portion closed at the toe end and a leg portion closed at the upper end except for air inlet means enabling said sock, after insertion in a boot, to be inflated to pressurize the boot from the interior thereof, air pressure relief means being provided to enable the sock to be deflated prior to removal from the boot, and a handle means being provided which is accessible at the upper end of the leg portion of the inserted sock to facilitate removal of the deflated sock from the boot.

By inserting the inflatable sock into a boot, inflating the sock, and leaving the boot pressurized by the inflated sock for a period of time, the boot can be restored substantially to its unmarked condition. The sock is then readily deflated and easily removed from the boot by use of the handle means. The handle means can additionally be used to hang the shaper from a suitable peg or the like both when in use or not in use, and also to facilitate carrying.

The sock may incorporate a shaping skeleton, i.e. reinforcing rib cage or like device, substantially to maintain the shape of the sock in its deflated condition and thereby facilitate its insertion into the boot.

The air pressure relief means preferably comprises a manually operable relief valve at the upper end of the leg of the sock. In one embodiment, however, the air inlet means comprises an air inlet valve adapted for connection of a separate air pump, and in this case the said air inlet valve may be of the type conventionally used in inflatable swimming rings and the like, normally acting only to admit air but having a needle or plunger which can be manually depressed to permit release of air from the interior. Thus, the air inlet valve may also constitute the air pressure relief means.

In another embodiment, the air inlet means comprises an air pump integrally connected with the sock at the upper end of the leg. Said air pump may have a body extending into the sock so as also to serve as a shaping skeleton for the purpose previously mentioned. The air pump preferably comprises a relatively rigid tube extending from a closed end at the upper end of the sock to an open end within the sock interior, a piston within the tube, a manually operable plunger connecting to the piston through the closed end of the tube, and valving means associated with the pump whereby the sock is infalted by reciprocation of the plunger. In this embodiment, the air pressure relief may alternatively comprise a normally closed valve through the piston which can be opened by a depression of the plunger beyond its normal stroke.

Alternatively, the air inlet means may comprise a balloon-type inflator operable through an air inlet and/or air pressure relief valve, to which valve the inflator is permanently or detachably connected.

In the above-mentioned possible embodiments, the handle means may take various forms, such as a strap or finger grip, and especially in the case of a strap may be detachable from the part of the shaper to which it is connected, which part may be constituted for example by the upper end of the leg portion of the sock or a permanently connected pump or inflator. In certain preferred embodiments the handle means comprises a flat strip of flexible material, to enable flat packing of a deflated shaper.

BRIEF DESCRIPTION OF THE DRAWINGS

The invention will be further described, by way of example, with reference to the accompanying drawings, in which.

DETAILED DESCRIPTION OF THE DRAWINGS

Figure 1:
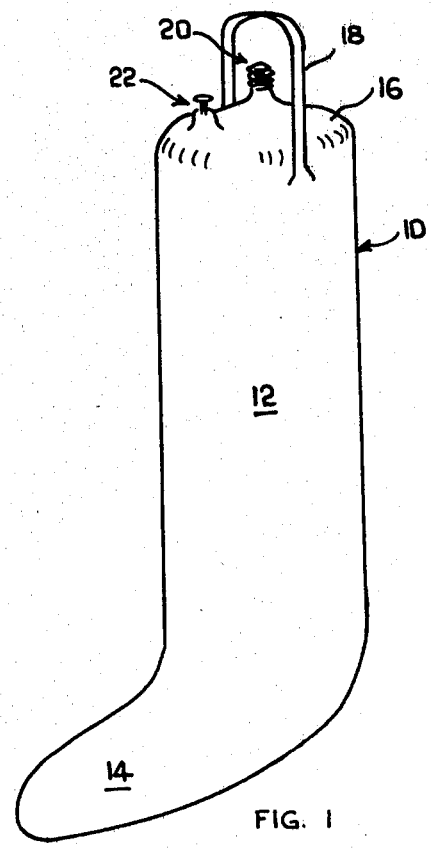
FIG. 1 shows in perspective a first embodiment of boot shaper.
Figure 2:
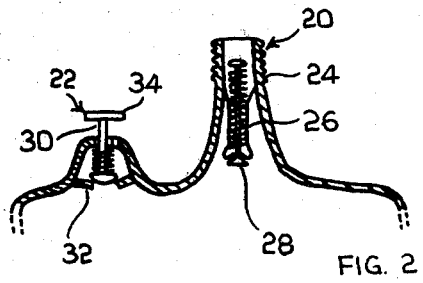
FIG. 2 is a cross section through the cap of the boot shaper of FIG. 1, diagrammatically indicating the structure of the valves.

The embodiment of boot shaper shown in FIGS. 1 and 2 comprises an inflatable sock 10 made of sheet rubber or other suitable impervious flexible sheet material. The sock 10 has a leg portion 12 and a foot portion 14 closed at the toe end. The leg portion is closed at its upper end by a valved reinforced cap 16, and is provided with an integrally attached handle 18 in the form of a flat strip of flexible material extending from one side of the sock to the other above the end of the sock so as to protrude beyond the top, open end of a boot when the sock has been inserted thereinto and pressurized, the handle thus enabling the sock to be readily pulled out of the boot after use. The handle 18 also enables the sock to be suspended from a hook or the like, both when in use and when not in use, especially the latter, and also enables the boot shaper to be readily carried.

There are two valves in the cap, an air inlet valve 20 through which the sock can be inflated and an air pressure relief valve 22 through which the sock can be deflated.

The air inlet valve 20 is of a conventional type, having a nozzle 24 enabling a separate pump (not shown) to be attached, such as a hand pump or a foot pump, in which nozzle is incorporated a tubular valve casing 26 in which is slidable a spring-loaded, headed needle or plunger 28. The valve opens under pressure of air applied into the nozzle 24 from the separate pump, thereby to inflate the sock. However, the plunger 28 can be manually depressed with a pointed tool, thereby permitting exit of air from the sock.

The air pressure relief valve 22 has a spring loaded plunger 30 adapted to remain closed on a seating 32 up to a predetermined high internal pressure, the plunger 30 carrying an exposed head 34 which can be utilized to lift the plunger manually, open the valve and thereby deflate the sock.

In use, the deflated, or preferably partially inflated, sock is inserted into the boot to be pressurized to reduce or eliminate crease or stretch marks. The sock is then fully inflated to chosen internal air pressure by use of the separate pump. The boot is then left in pressurized condition for a period of time sufficient to treat the crease or stretch marks. Thereafter the sock is deflated by use of the air pressure relief valve and is easily removed by pulling on the handle while holding the boot.

Although not shown, the sock may incorporate a reinforcing rib cage or other shaping skeleton so that it substantially retains its shape in the deflated condition, thereby to assist its insertion into the boot without the preference for partial inflation first.

Figure 4:
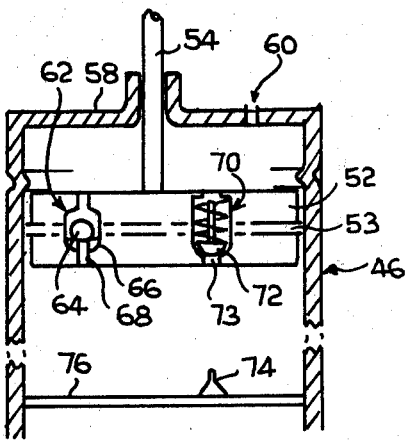
FIG. 4 is a cross section through the air pump tube of the embodiment of FIG. 3, diagrammatically indicating the structure of the valves.
Figure 3:
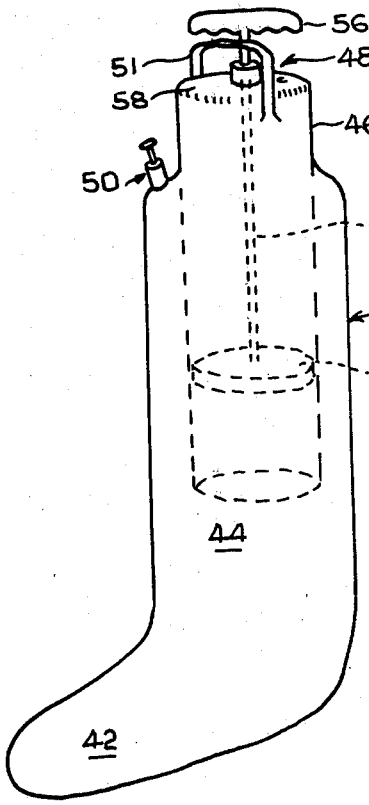
FIG. 3 shows a second embodiment in perspective.

The embodiment shown in FIGS. 3 and 4 differs from that of FIGS. 1 and 2 in that a pump is incorporated as part of the structure thereof. The sock 40 has foot portion 42 attached to leg portion 44, the upper end of which is bonded and sealed around a relatively rigid metal or plastics tube 46 which forms part of a pump, generally designated 48, which serves to close the upper end of the sock. An air pressure relief valve 50, similar to the valve 22 of the previous embodiment, is provided adjacent the upper end of the sock, to the outside of the tube 46. A flexible handle 51, equivalent to the handle 18 of the embodiment of FIG. 1, is integrally attached to the pump body 46.

The tube 46 constitutes the cylinder of the pump, wherein is slidable a piston 52 carried by a piston rod 54 terminated by a manually operable handle 56. Referring to FIG. 4, the closed top 58 of the tube (which is of course open at its bottom end), incorporates an air inlet 60. When the piston assembly is depressed, air is drawn into the top of the tube behind the piston. Said piston 52, carrying a rubber or other sealing ring 53, incorporates a valve 62 providing for passage of air from the tube behind the piston to the tube in front of the piston and thus into the sock. Conveniently, this valve 62 comprises a ball 64 supported on radial fingers 66 in such a manner as to seal a passage 68 through the piston except during upward movement of the piston. Thus, air is drawn into the top of the tube behind the piston 52 on its downstroke, and is drawn through the piston into the sock on its upstroke. During the upstroke, some air also exists through the air inlet 60, but this only slows down the rate of inflation of the sock to a relatively small extent. The effect can be avoided by incorporating a one-way valve in the inlet 60.

Assuming the air inlet 60 is left unobstructed, an alternative air pressure relief valve may be employed in the embodiment of FIGS. 3 and 4. This valve through the piston is generally designated 70. It comprises a spring loaded valve closure member 72 normally closing a passage 73 at all internal pressures up to a predetermined value, but operable by an additional depression of the piston 52, beyond the range of its normal downstroke, which brings the valve closure member 72 into engagement with an abutment 74 carried by a crosspiece 76 near the bottom of the tube 46.

Like the embodiment of FIGS. 1 and 2, the sock 40 of the second embodiment may be provided with a shaping skeleton (not shown). However, in the embodiment of FIGS. 3 and 4, the pump body 46 in itself acts as an internal skeleton assisting insertion of the shaper into the boot, and if desired can be externally shaped and extended specifically to serve for this purpose.

Figure 5:
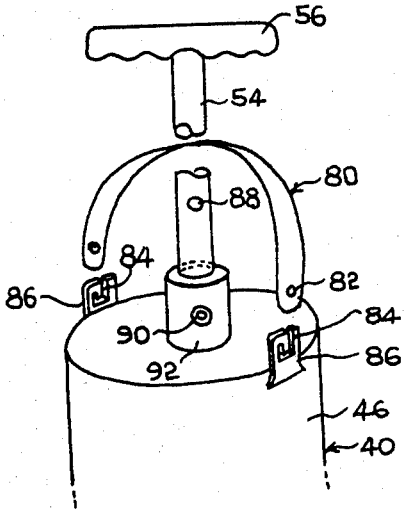
FIG. 5 shows two possible modifications of the handle means in the embodiment of FIG. 3.

FIG. 5 shows a modification to the embodiment of FIG. 3 in which the integral strap-type handle 51 is replaced by a detachable flexible handle 80 having studs 82 for engagement in a bayonet-type socket 84 provided in each of two diametrically opposed peripheral lugs 86 on the pump body 46.

The same figure conveniently also serves to show an alternative which can be used instead of the strap-type handle 51 or 80. In the fully depressed position of the pump handle 56, a recess 88 in the piston stem 54 of the air pump 48 is engageable by a push-button releasable detent 90 formed in a collar 92 of the pump body 46 through which the piston stem emerges. Engagement of the detent 90 with the recess 88 locks the pump handle 56 in position relative to the sock 40, enabling this handle also to serve as a handle means by which the sock, after deflation thereof, can be removed from a boot. In an alternative embodiment (not shown), the pump handle 56 may be similarly located in position by means of a bayonet-type fixing with the pump handle 56 including studs for engagement in bayonet-type sockets in the collar 92 of the pump body.

Figure 6A:
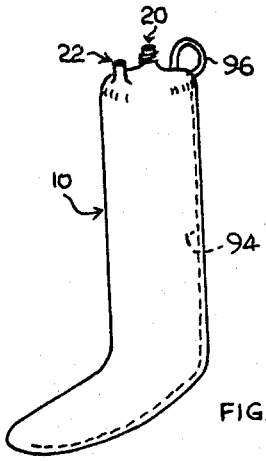
FIGS. 6A and 6B show a modification to the embodiment of FIG. 1.
Figure 6B:
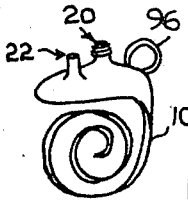

When the sock is not provided either with an internal rib-cage or an integral air pump which can serve as an internal skeleton, alternative means may be provided to assist insertion of the shaper, especially the foot portion thereof, into a boot. FIGS. 6A and 6B illustrate a modification in which the sock 10 is provided with a resilient insert or spine 94, e.g. of nylon tape or plastics-coated wire, having a permanent set which, when the sock is defined, coils it up in the manner indicated in FIG. 6B. The sock 10 is inserted into the boot in its coiled condition, and when inflated uncoils to assume the shape indicated in FIG. 6A in which it fills the boot in the same manner as the sock of FIG. 1. When deflated prior to removal from the boot, the sock coils up again, and is removable from the boot by use of handle means in the form of a finger grip 96.

Figure 7:
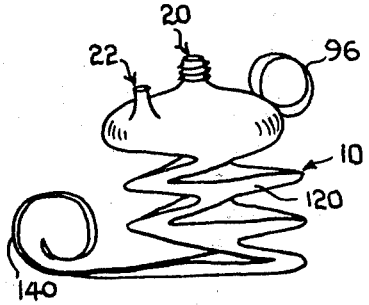
FIG. 7 shows an alternative modification to the embodiment of FIG. 1.

FIG. 7 shows an alternative means to assist insertion, wherein the sock 10 is formed with a concertina-like leg portion 120 and a coiled-up foot portion 140. Coiling of the foot portion 140 can be assisted, if desired, by provision of a resilient insert or spine on this portion of the sock. The partly concertina-folded/partly coiled sock 10 is inserted to the inside heel region of the foot, the foot portion 140 uncoiled and the leg portion 120 pulled up (if necessary freeing the air inlet valve during the latter step) to stretch the concertina-type folds. Inflation may then be effected in the usual manner. Removal of the sock from the boot after deflation is again assisted by a finger grip 96.

It will also be clear without illustration that, if the sock is made of a flexible material which is relatively non-resilient, i.e. ready to conform to folding or coiling with minimum tendency to unfold or uncoil to its natural shape, insertion of the sock may be assisted, without provision of any special means for the purpose, simply by coiling of the foot portion towards the heel and the leg portion towards the coiled foot portion. Having inserted the thus coiled sock into the inside heel region of the boot, uncoiling of the foot and leg portions is, if necessary, effected by hand prior to inflation. A handle means will again be provided to assist removal of the sock from the boot.

In all the above cases, it will be desirable for the upper end region of the leg portion of the sock, which region may desirably be thickened or reinforced for strength, to be crushable inwardly so that it can be pushed past the narrowed cross-section of the calf of the boot into the inside heel region.

Instead of using an air pump, either separate or integral, to inflate the sock, a simple balloon-type inflator may be employed. Such a balloon inflator will be similar to that used in a sphygmomanometer. The balloon inflator may be connectable or connectible to an air inlet valve on the sock, or if permanently connected to the sock, may in itself incorporate all the necessary valves, such as one-way inlet valve, one-way outlet valve, push-button pressure relief valve and/or over-pressure relief valve.

A detachable inflator is advantageous in that it can serve to inflate two or more socks required for simultaneous use, but has the disadvantage that the inflator may be mislaid or lost. Thus, for simultaneous inflation of two socks for a pair of boots, a balloon-type inflator permanently attached to one sock may have an extra optionally usable air outlet tube for connection to a second sock. Connection of a detachable balloon-type inflator (or an air outlet tube thereon) may be by means of bayonet-type couplings which compress O-ring seals.

Figure 8:
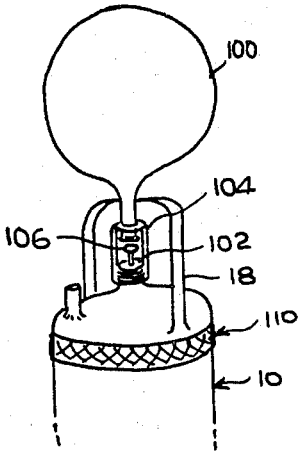
FIG. 8 shows an embodiment having an alternative inflating device to the air pump of FIG. 3.

By way of example FIG. 8 illustrates one arrangement using a balloon-type inflator 100. The inflator 100 fits to the air inlet valve 102 of a sock 10 having an integral flexible handle 18. The inflator 100 fits to the valve 102 through the intermediary of a skeleton sleeve 104 which permanently retains the inflator while enabling it to be lifted to expose, through the skeleton wall of the sleeve, a spigot 106 on the inlet valve which is depressible to effect pressure relief and sock deflation.

Conveniently, the sock will be made either by welding sheet plastics material cut to a suitable pattern, or by any one of a number of possible plastics molding techniques. Often, the finished sock will have a very smooth and slippery external surface, which may give rise to a tendency for the fully inflated sock to ease itself outwardly of the leg of the boot. In order to avoid this possible disadvantage if it arises, a band of non-slippery material such as a cotton or jute fabric is applied around the outside of the upper end of the leg portion of the sock. Such a band of material is for convenience shown in FIG. 8, wherein it is referenced 110.

The above-described embodiments are by way of example only; various other constructions are possible within the scope of the invention as defined by the appended claims.

I claim:

1. A boot shaper comprising a sock of impervious flexible material, said sock having:

a foot portion closed at the toe end;

a leg portion closed at the upper end except for access for inflation;

an air inlet means providing said access for inflation of the sock after insertion in a boot, thereby to pressurize the boot from the interior thereof;

an air pressure relief means for deflation of the sock prior to removal from the boot;

a handle means accessible at the upper end of the boot to enable removal of the deflated sock from the boot; and a resilient spine serving to coil the sock in the deflated condition.

2. A boot shaper comprising a sock of impervious flexible material, said sock having:

a foot portion closed at the toe end, said foot portion being adapted for coiling;

a leg portion closed at the upper end except for access for inflation, said leg portion being adapted for concertina-type folding;

an air inlet means providing said access for inflation of the sock after insertion in a boot, thereby to pressurize the boot from the interior thereof;

an air pressure relief means for deflation of the sock prior to removal from the boot; and a handle means accessible at the upper end of the boot to enable removal of the deflated sock from the boot.

3. A boot shaper as claimed in claim 1 or 2 wherein the handle means comprises a flat flexible strip.

4. A boot shaper as claimed in claim 1 or 2 wherein the air pressure relief means comprises a manually operable relief valve at the upper end of the leg of the sock.

5. A boot shaper as claimed in claim 1 or 2 wherein the air inlet means comprises an air inlet valve adapted for connection of a separate air pump.

6. A boot shaper as claimed in claim 5, wherein said air inlet valve also constitutes the air pressure relief means.

7. A boot shaper as claimed in claim 1 or 2 wherein the air inlet means comprises an air pump integrally connected with the sock at the upper end of the leg.

8. A boot shaper as claimed in claim 7 wherein said pump comprises a relatively rigid tube extending from a closed end at the upper end of the sock to an open end within the sock interior, a piston within the tube, a manually operable plunger connecting to the piston through the closed end of the tube, and valving means associated with the pump whereby the sock is inflated by reciprocation of the plunger.

9. A boot shaper as claimed in claim 2 wherein the sock has a resilient spine serving to coil said sock in the deflated condition.

10. A boot shaper as claimed in claim 1 wherein the foot portion of the sock is adapted for coiling and the leg portion is adapted for concertina-type folding in the deflated condition of the sock.

11. A boot shaper as claimed in claim 1 or 2 wherein the shaper is made of smooth-finish plastics material.

12. A boot shaper as claimed in claim 11 further comprising a band of non-slippery fabric around the exterior of the leg portion at or adjacent the upper end thereof.

* * * * *